US007048125B2

(12) United States Patent
Mize et al.

(10) Patent No.: US 7,048,125 B2
(45) Date of Patent: May 23, 2006

(54) PATCH BAG HAVING PATCH COVERING SEAL

(75) Inventors: James A. Mize, Simpsonville, SC (US); H. Walker Stockley, Spartanburg, SC (US); James L. Rowray, Robins, IA (US)

(73) Assignee: Cryovac, Inc., Duncan, SC (US)

( * ) Notice: Subject to any disclaimer, the term of this patent is extended or adjusted under 35 U.S.C. 154(b) by 294 days.

(21) Appl. No.: 10/325,514

(22) Filed: Dec. 19, 2002

(65) Prior Publication Data

US 2004/0118735 A1 Jun. 24, 2004

(51) Int. Cl.
*B65D 65/00* (2006.01)

(52) U.S. Cl. ..... 206/497; 206/484; 383/119

(58) Field of Classification Search ..... 206/484, 206/484.1, 484.2, 524.1, 524.2, 524.3, 524.6, 206/497; 383/94, 109, 113, 116, 119
See application file for complete search history.

(56) References Cited

U.S. PATENT DOCUMENTS

| | | | | |
|---|---|---|---|---|
| 4,239,111 | A * | 12/1980 | Conant et al. | 206/484 |
| 4,457,960 | A * | 7/1984 | Newsome | 428/34.9 |
| 4,539,236 | A | 9/1985 | Vilutis | |
| 4,755,403 | A | 7/1988 | Ferguson | |
| 5,302,402 | A | 4/1994 | Schuetz et al. | |
| 5,534,276 | A | 7/1996 | Ennis | |
| 5,545,419 | A | 8/1996 | Brady et al. | |
| 5,846,620 | A | 12/1998 | Compton | |
| 6,270,819 | B1 | 8/2001 | Wiese | |
| 6,287,613 | B1 | 9/2001 | Childress et al. | |
| 6,296,886 | B1 | 10/2001 | DePoorter et al. | |
| 6,383,537 | B1 | 5/2002 | Brady et al. | |

FOREIGN PATENT DOCUMENTS

| | | |
|---|---|---|
| EP | 0 873 266 B1 | 10/1998 |
| EP | 0 913 338 A3 | 5/2000 |
| WO | 97/24272 | 7/1997 |
| WO | 98/45187 | 10/1998 |

* cited by examiner

*Primary Examiner*—John A. Ricci
(74) *Attorney, Agent, or Firm*—Rupert B. Hurley, Jr.

(57) ABSTRACT

A patch bag comprises a lay-flat bag having a patch adhered thereto. The bag has an open top, a closed bottom, and first and second closed sides. The bag is made from a bag film having an inside surface which is sealed to itself. The bag film includes a seal impression on its outside surface. The patch is made from a patch film which is adhered to the outside surface of the bag film. The patch covers at least a portion of the seal impression on the outside surface of the bag film. The patch has a smooth, unimpressed outer surface over the seal impression on the bag film. A process for making the patch bag comprises sealing the bag film to itself and thereafter adhering the patch to the bag, with the patch being adhered over the seal impression on the bag film.

12 Claims, 9 Drawing Sheets

PATCH BAG HAVING PATCH COVERING SEAL

FIELD OF THE INVENTION

The present invention relates to the packaging of products in bags made from a puncture-resistant flexible film. More particularly, the present invention relates to a patch bag, as well as processes of making a patch bag.

BACKGROUND OF THE INVENTION

Various patch bags have been commercialized for the packaging of bone-in fresh meat products, especially fresh red meat products and other bone-in meat products, such as whole bone-in pork loins, etc. The patch on the bag reduces the likelihood that the bag will be punctured by bones which protrude from the meat product.

It is desirable to provide a patch which covers as much of the bag as possible, while at the same time being both efficient to manufacture and efficient to use. In the manufacture of patch bags by a preferred process, the bag film is provided in the form of a continuous tubing, with the patches being adhered intermittently (or continuously) to one or both sides of the tubing. After the patches have been adhered to the tubing, the resulting tubing/patch laminate is converted into patch bags by heat sealing across the tubing and cutting across the tubing. Such seals are referred to as "factory seals" because they are made by the patch bag manufacturer, rather than the meat packer who makes a seal across the top of the patch bag. Both end-seal patch bags and side-seal patch bags have been manufactured in this manner.

More particularly, in the manufacturing process, efficiency has been gained by adhering a plurality of patches at repeating intervals to one or both sides of the continuous tubing, so that the seals later made across the tubing are in an area not covered by a patch. This allows for fast, efficient, and strong hermetic seals to be made, because heat need only be passed through the bag film, as opposed to both the patch film and the bag film. A disadvantage of the resulting product is that the seal area is not covered by a patch, and hence is more vulnerable to puncture. For some bone-in cuts of meat, having an uncovered seal area is a significant disadvantage, for example, if the particular bone-in meat cut has a sharp bone end in contact with the uncovered seal area of the patch bag.

In response to this disadvantage, more recently there has been developed a patch bag having a patch which covers the seal area. Such patch bags have been made by heat sealing through both the patch and the bag during conversion of the tubing/patch laminate to a patch bag. However, it has proven to be difficult to efficiently obtain high seal strength without burning through the patch and/or bag films, and it has also proven to be a much slower, less efficient conversion process than for patch bags in which the patch did not cover the seal area, as it has proven to be difficult to quickly heat the bag film to the required temperature for sealing when having to apply heat through the patch film. Special sealing means was developed to speed the sealing process and obtain the desired seal strength when applying heat through the relatively thick patch film.

It would be desirable to have patch coverage at the seal area without having to make the seal by passing heat through the patch film.

SUMMARY OF THE INVENTION

The present invention is directed to both a process for making a patch bag as well as the patch bag itself. It has been discovered that it is possible to first seal a heat-shrinkable bag film and thereafter apply a heat-shrinkable patch over the heat seal made through the heat-shrinkable bag film. The process provides patch coverage over the seal itself, while taking advantage of the seal efficiency and seal strength obtainable for patch bags which do not have patch coverage in the seal area. The patch bag of the present invention differs from previous patch bags in that the portion of the patch which covers the seal area does not have an impression thereon due to contact with the heat sealing apparatus. That is, although the heat seal leaves an "impression" in/on the bag film, that portion of the patch which is adhered directly over the seal remains relatively smooth.

As a first aspect, the present invention is directed to a patch bag comprising a bag having a patch adhered thereto. The bag is a lay-flat bag having an open top, a closed bottom, and first and second closed sides. The bag is made from a bag film, with the bag including a seal of an inside surface of the bag film to itself. The bag has a seal impression on an outside surface lo thereof. The patch comprises a patch film, and the patch film is adhered to the outside surface of the bag. The patch covers at least a portion of the seal impression on the outside surface of the bag film. The patch film has a smooth, unimpressed outer surface directly over the seal impression on the outside surface of the bag film. That is, the patch film is free of the seal impression on the bag film.

Although the patch film and/or the bag film can be non-heat-shrinkable, i.e., have a total free shrink at 185° F. of from 0 to less than 10 percent, preferably, the bag film is heat-shrinkable, and preferably the patch film is also heat-shrinkable. Preferably, the bag film is heat shrinkable and exhibits a total free shrink of from 10 to 150 percent at 185° F. Preferably, the patch film is heat shrinkable and exhibits a total free shrink of from 10 to 150 percent at 185° F., more preferably 10–110 percent, more preferably 15–100 percent, more preferably 20–80 percent, more preferably 30–80 percent percent.

In one embodiment, the bag is an end seal bag, with the bag film being in the form of a seamless tubing, and the seal being a transverse end seal across the bag film. In one preferred variation of this embodiment, the patch is a first patch adhered to an outside surface of a first lay-flat side of the bag, with the first patch having a first overhanging portion which overhangs a first side edge of the bag and a second overhanging portion which overhangs a second side edge of the bag. This variation further comprises a second patch adhered to an outside surface of the second lay-flat side of the bag, the second patch having a first overhanging portion which overhangs the first side edge of the bag and a second overhanging portion which overhangs the second side edge of the bag. The first overhanging portion of the first patch and the first overhanging portion of the second patch are adhered to one another, with the second overhanging portion of the first patch and the second overhanging portion of the second patch also being adhered to one another, with both the first and second patches covering the transverse end seal.

The end seal bag can be provided with a skirt below the end seal, with the patch covering a portion of the skirt, and with the bag film having a tear notch present in the skirt region. The tear notch extends from a bottom edge of the bag to a position below the end seal. Although the tear notch should be through the bag film, if below an area covered by the patch, preferably the tear notch is also through the patch film.

The end seal can be straight or curved. One preferred curved shape is an end seal which is convex with respect to the bottom edge of the bag. In one preferred embodiment, an end-seal bag having a convex seal also has patches having overhanging regions adhered to one another, as described above. As used herein, the word "convex" is used with respect to a bag edge, a patch edge, or a seal, and refers to the edge or seal having a curved shape which, when viewed from a position outward from the edge or seal, presents an outwardly curved line, surface, or shape.

In another embodiment, the patch bag comprises a side-seal bag having a first side seal along a first side edge of the bag and a second side seal along a second side edge of the bag, with both the first and second side seals extending a full length of the bag. The patch covers at least a portion of at least one of the side seals, but preferably covers a portion of both side seals. In a preferred variation of this embodiment, a first patch is adhered to an outside surface of a first lay-flat side of the bag, with the first patch overhanging a bottom edge of the bag, the patch bag further comprising a second patch adhered to an outside surface of a second lay-flat side of the bag, with the second patch also overhanging the bottom edge of the bag, with an overhanging portion of the first patch being adhered to an overhanging portion of the second patch.

The side seal bag can have a skirt outward of the first side seal, with the skirt extending from the first side seal to a first side edge. The patch can cover at least a portion of the skirt. The bag can have a tear notch in the skirt, the tear notch being at least through the bag film. If the tear notch is positioned so that a tear straight across the bag would be through the patch, it is preferable that the tear notch is also through the patch film. The tear notch in the skirt extends from the side edge of the bag towards the side seal.

The patch is adhered to the bag. Preferred means for adhering the patch to the bag include adhesive as well as corona treatment. If the patch is adhered to the bag with corona treatment, it is preferable that the bag film comprises ionomer resin, at least in the outer layer of the bag film which is to be adhered to the patch; it is also preferable that the patch film comprise ionomer, at least in the layer which is to be adhered to the bag film with the corona treatment.

As a second aspect, the present invention is directed to a process for making a patch bag. The process comprises sealing an inside surface of a bag film to itself, the sealing being carried out so that the bag film has a seal impression on an outside surface thereof. After the bag film is sealed to itself, at least one patch is adhered to the outside surface of the lay-flat bag film, to form a patch/bag laminate. The patch is made from a patch film, with the patch film covering at least a portion of the seal impression on the outside surface of the bag film. The patch film has a smooth, unimpressed outer surface over the seal impression on the outside surface of the bag film.

Preferably, the sealing is heat sealing and the lay-flat bag film is a heat-shrinkable film and is present in the form of a continuous length of film which is maintained under tension in a machine direction during heat sealing, i.e., the portion of the continuous length being sealed is held under tension during heat sealing and while the seal cools. Preferably, the bag film is held under a tension of from 5 to 100 pounds during the heat sealing.

Preferably, the heat sealing comprises making a plurality of seals across the length of the lay-flat bag film, with the seals being spaced apart from one another at one or more regular intervals. Preferably, the process further comprises converting the bag film/patch laminate to a plurality of patch bags by cutting at least across the continuous bag film/patch laminate, so that the patch bag has an open top, a closed bottom, and closed sides.

In one embodiment of the process, the lay-flat bag film is a continuous seamless tubing which is sealed to itself and after patch lamination is converted into a plurality of end-seal patch bags. In another embodiments, the lay-flat bag film is a continuous seamless tubing which is sealed to itself and after patch lamination is converted to a plurality of side-seal patch bags.

Although the bag film can be a seamless tubing which is sealed to itself and thereafter converted to an end-seal or side-seal bag, alternatively the bag film is a flat film which is folded and sealed to itself to form a lay-flat bag, with one or more patches thereafter being adhered to the sealed bag film, the patches covering at least a portion of one or more of the seals. The process can be carried out by folding a flat bag film and sealing it to itself, with a seamless fold along a first side edge, a side seal along a second side edge, and a bottom seal along a bottom edge of the bag, i.e., an "L-seal" bag, which, although not illustrated herein, is disclosed and illustrated in EP 0 913 228 A2. Alternatively, the flat film can be folded and sealed so that it has a seamless fold along a bottom edge, a first side seal along a first side edge, and a second side seal along a second side edge, i.e., a side-seal bag, as also disclosed and illustrated in EP 0 913 228 A2. In yet another embodiment, the lay-flat bag film is a continuous flat film which is folded and sealed to itself and after patch lamination is converted to a plurality of L-seal bags. In yet another embodiment, the lay-flat bag film is a continuous flat film which is folded and sealed to itself and after patch lamination is converted to a plurality of side-seal bags.

DETAILED DESCRIPTION OF THE INVENTION

Figure 1A:
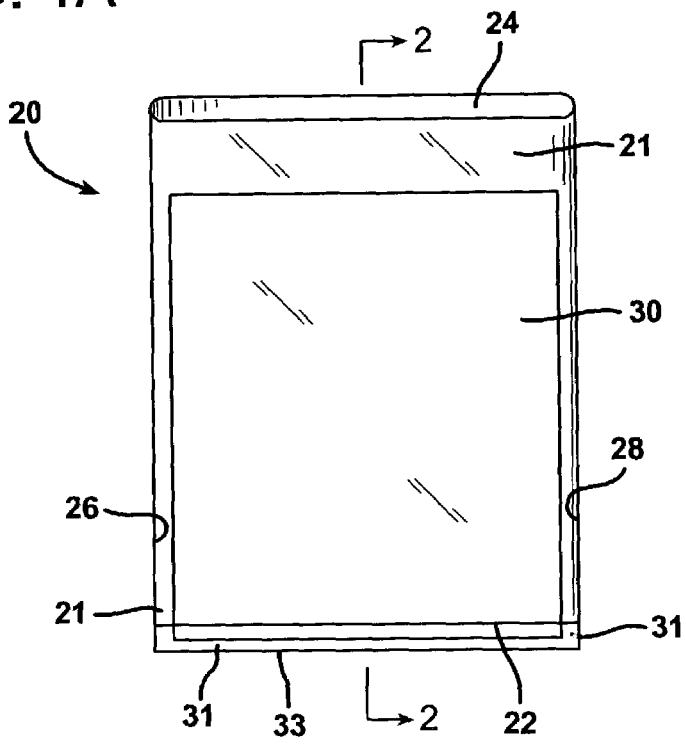
FIG. 1A illustrates a lay-flat view of an end-seal patch bag in accordance with the present invention.

As used herein, the term "bag" is inclusive of end-seal bags, L-seal bags, side-seal bags, backseamed bags, and pouches. End-seal, side-seal, and L-seal bags are illustrated in various figures included herewith, and are discussed below. A backseamed bag is a bag having an open top, a seal running the length of the bag in which the bag film is either fin-sealed or lap-sealed or butt sealed with a butt-seal tape, two seamless side edges, and a bottom seal along a bottom edge of the bag. Pouches are made from two separate pieces of flat film, and have a bottom seal and two side seals, i.e., are "U-sealed".

Although seals along the side and/or bottom edges can be at the very edge itself, (i.e., seals of a type commonly referred to as "trim seals"), preferably the seals are spaced inward (preferably ¼ to ½ inch, more or less) from the bag side edges, with the film extending outwardly from the seal to the edge being referred to as a "skirt".

As used herein, the term "closed", with respect to the bottom edge of the bag and/or one or more of the side edges of the bag, refers to the respective bottom or side edge as having a seamless fold or a seal (preferably a heat seal) which closes the bottom or side so that the bag is not open for the product to escape from the edge. Preferably, the barrier is a hermetic barrier. Moreover, a side edge or bottom edge is considered to be "closed" regardless of whether there is a skirt outward of a seal.

As used herein, the phrase "the patch film having a smooth, unimpressed surface over the seal impression of the outside surface of the bag film" is used with reference to the portion of the outer surface of the patch film which is adhered directly over the seal of the bag film to itself. Although it is possible to manually "feel" the heat seal through the overlying patch, the outer surface of that portion of the patch film which is directly over the heat seal is relatively smooth, i.e., is impression-free, because the seal of the bag film is made through the bag before the patch film is adhered to the already sealed bag film. Of course, the patch film, because it is adhered over the location of the seal impression, necessarily follows the contour of the bag film, including the seal of the bag film to itself. However, one can easily look at the patch bag of the invention and readily determine that although there is a seal of the bag film to itself, the seal is not made through that portion of the patch film which covers the seal of the bag film to itself. If heat to form the seal is applied through the patch film, the surface of the patch film takes on a seal impression similar to the impression on the surface of the bag film. The absence of the seal impression on the patch film reveals that the seal was not made through the patch film, i.e., that the patch was adhered to the bag after the seal was made through the bag film.

As used herein, the phrases "heat-shrinkable," "heat-shrink" and the like refer to the property of an oriented film to shrink upon the application of heat, i.e., to contract upon being heated, such that the size (area) of the film decreases if the film is not restrained when heated. Likewise, the tension of a heat-shrinkable film increases upon the application of heat if the film is restrained from shrinking. Preferably, the heat shrinkable film has a total free shrink (i.e., machine direction plus transverse direction), measured in accordance with ASTM D 2732, of at least 10 percent, more preferably at least 15 percent, and more preferably, at least 20 percent.

The term "tear notch" as used herein, is inclusive of a cut (straight or curved), a cutout in which a portion of one or more films has been removed, a perforation, and a tear.

Figure 2:
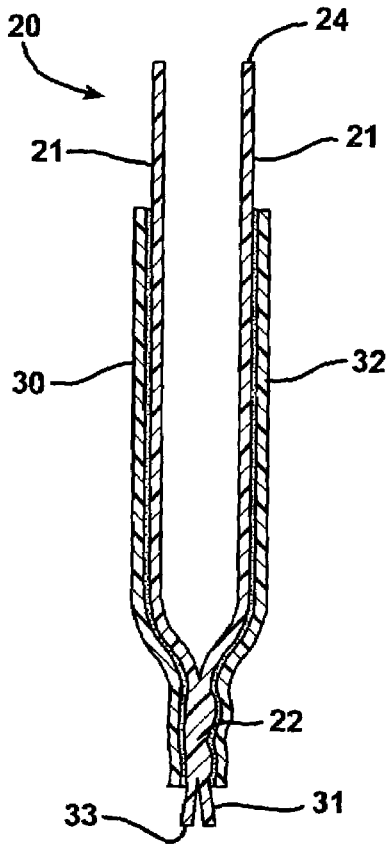
FIG. 2 illustrates a longitudinal cross-sectional view of the patch bag of Figure IA, taken through section 2—2 thereof.
Figure 3:
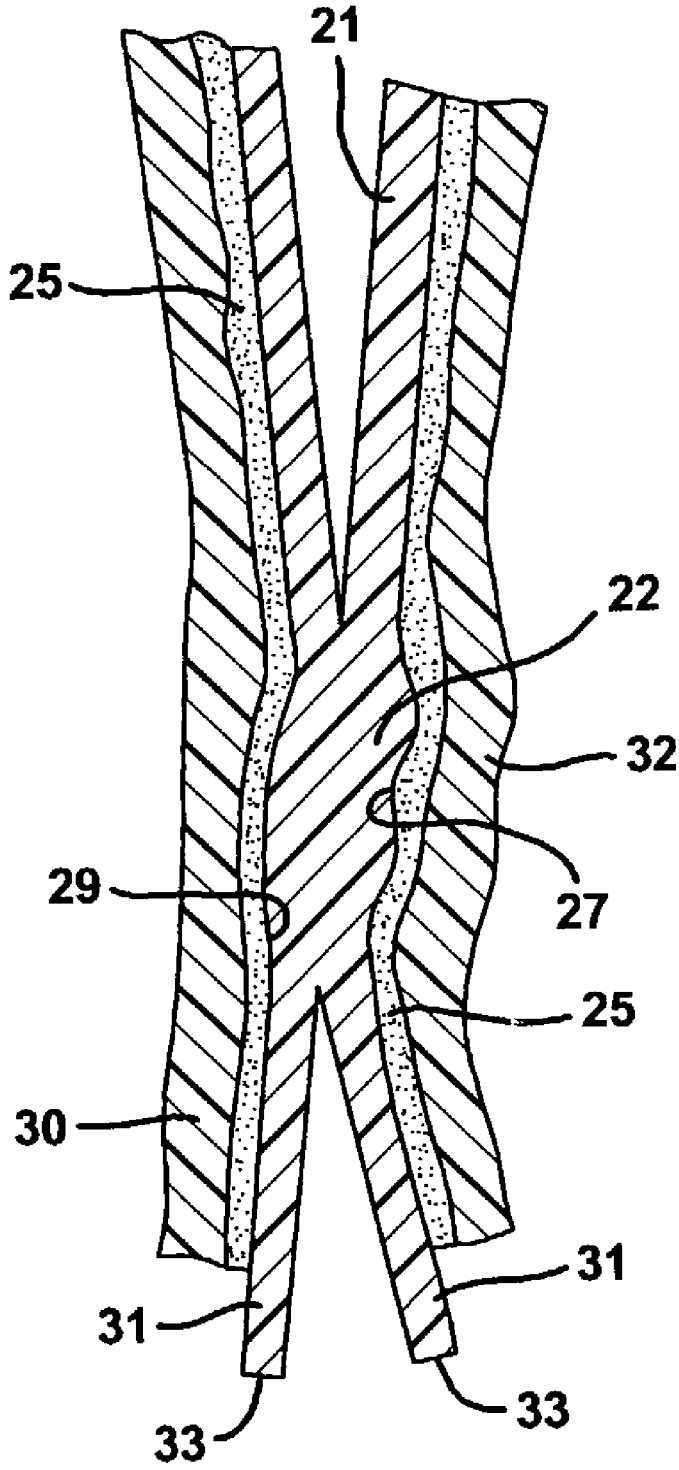
FIG. 3 illustrates a greatly enlarged view of a portion FIG. 2 which includes the seal of the bag film to itself, with the patch adhered over the sealed impression on the bag film.

FIG. 1A illustrates a preferred lay-flat end-seal patch bag 20, in a lay-flat position, this 20 patch bag being in accordance with the present invention. FIG. 2 is a longitudinal cross-sectional view of patch bag 20, taken through section 2—2 of FIG. 1A. FIG. 3 is an enlarged view of the seal portion FIG. 2. Viewing FIGS. 1A, 2, and 3 together, patch bag 20 comprises bag 21 having first patch 30 adhered to a first lay-flat side of bag 21, and a second patch 32 adhered to a second lay-flat side of bag 21. Bag 21 is formed from a seamless tubing and has an open top established by top edge 24, first and second side edges 26 and 28, transverse end seal 22 forming the bottom of the bag, and tail portion 31 having bottom edge 33. First patch 30 and second patch 32 are both adhered to bag 20 with an adhesive, and as illustrated in FIG. 1A, both first patch 30 and second patch 32 cover a portion, but not the entire length, of transverse end seal 22. First patch 30 and second patch 32 have a width less than the lay-flat width of bag 21, and do not extend to either first bag side edge 26 or second bag side edge 28. Moreover, neither first patch 30 nor second patch 32 extend to top edge 24, leaving an upper region of the bag uncovered so that after a product is placed in the bag, the packer can make a seal through bag 21 without having to seal through either patch 30 or patch 32.

FIG. 3 provides an enlarged and detailed cross-sectional view of seal 22 of the bag film to itself, together with first patch 30 and second patch 32 adhered to bag 22 with adhesive 25 between bag 21 and patches 30 and 32. As can be seen in FIG. 3, seal 22 produces seal impressions 27 and 29 on the respective surfaces of the film from which bag 21 is made. Concave seal impression 27 is produced by pressure and heat from a hot seal wire used in an impulse sealing apparatus, which also produces convex seal impression 29 on the opposite side of the seal. However, it should be noted that patch 30 and patch 32 both remain "smooth", i.e., "impression-free", over seal 22. Although adhesive 25 is illustrated as filling in the entire gap between patch 30 and seal 22, and between patch 32 and seal 22, depending upon the amount of adhesive applied and the height of seal impressions 27 and 29, there can be small air pockets around the seal. However, the seal and patch illustrated in FIG. 3 are the result of a process in which the film tubing from which the bag is made is first transversely sealed while in the form of a continuous web, followed by the patches being adhered to the tubing at regular intervals, the patches being spaced apart from one another. Of course, the patches are adhered to both sides of the tubing, and are adhered over the transverse seal. Preferably, the bag film is a heat-shrinkable film, and preferably the bag film is held under tension during heat sealing, as disclosed in detail below.

Figure 1B:
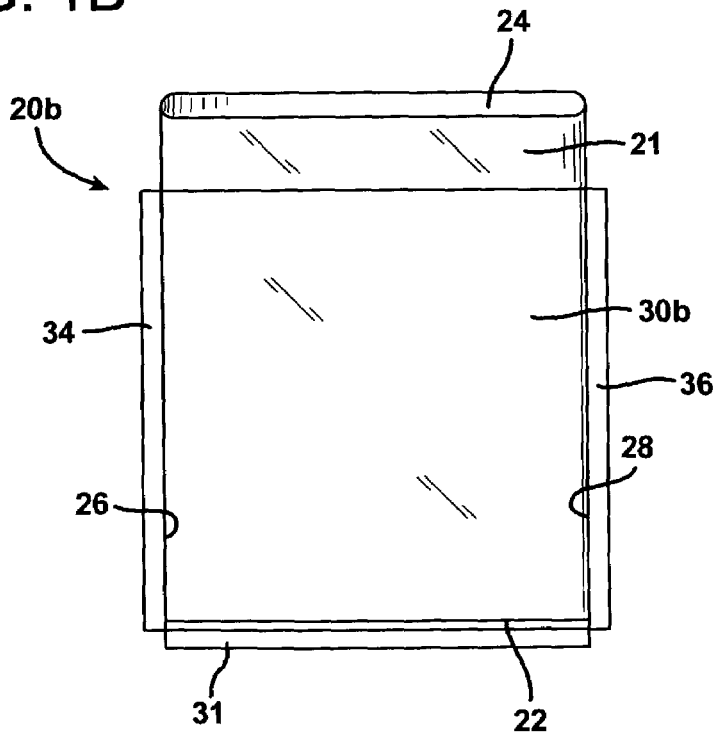
FIG. 1B illustrates a lay-flat view of a first alternative end-seal patch bag in accordance with the present invention.

FIG. 1B illustrates patch bag 20B, which is another preferred end-seal patch bag in accordance with the present invention. Patch bag 20B is similar to patch bag 20 of FIG. 1A, but differs in that it has patch 30B (see FIG. 1B) on its first lay flat side, and corresponding patch 32B (not illustrated) adhered to its second lay flat side. Each of patches 30B and 32B overhang side edges 26 and 28 of bag 21. Patch 30B has first overhang 34 over first bag side edge 26, and second overhang 36 over second bag side edge 28. Patch 32B (not illustrated) has corresponding overhangs on over side edges 26 and 28. The overhanging portions of patches 30B and 32B are adhered to one another with the adhesive, which is applied to the patches before they are adhered to bag 21. Notably, in FIG. 11B, end seal 22 extends only across bag 21, and does not extend into overhangs 34 and 36. This is because end-seal 21 is made before patches 30B and 32B are adhered to bag 21.

Figure 1C:
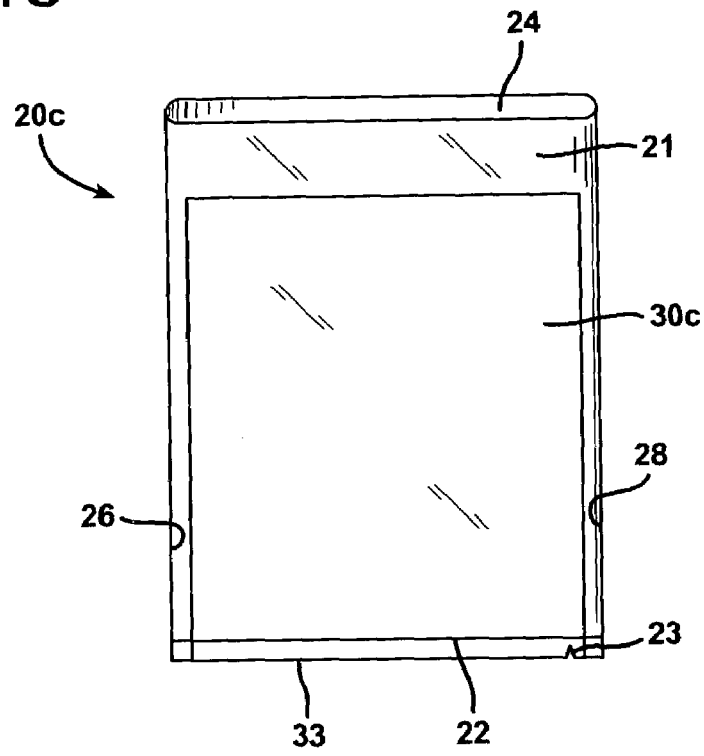
FIG. 1C illustrates a lay-flat view of a second alternative end-seal patch bag in accordance with the present invention.

FIG. 1C illustrates patch bag 20C, which is another preferred end-seal patch bag in accordance with the present invention. Patch bag 20C is similar to patch bag 20 of FIG. 1A, but differs in that it has patch 30C on its first lay flat side (see FIG. 1C) and corresponding patch 32C (not illustrated) adhered to its second lay flat side. Rather than stopping short of bottom edge 33 of bag 21, each of patches 30C and 32C extend all the way to bottom edge 33 of bag 21. In FIG. 1C, a longitudinal cross-sectional view of the seal region appears generally as illustrated in FIG. 3, except that patches 30C and 32C extend all the way to bottom edge 33. Tear notch 23 on bottom edge 33 provides a means for easy-opening of the package after a product is placed inside (as tear notch 23 is through both lay-flat sides of the bag film and both patch films), and sealed within, patch bag 20C. A tear notch can be a straight cut, a curved cut, or V-shaped cutout, and although can be through the bag film alone, is preferably through both the bag film and the patch film.

Patches 30C and 32C extend to bottom edge 33, with tear notch 23 being through both lay-flat sides of the bag as well as through patch 30C and patch 32C. This assists in initiating a longitudinal tear through both patches and both lay-flat sides of the bag, to facilitate easy opening. More particularly, the notch assists in forming a tear upward, through seal 22 and along the length of both bag 21, as well as through patches 30C and 32C.

Figure 1D:
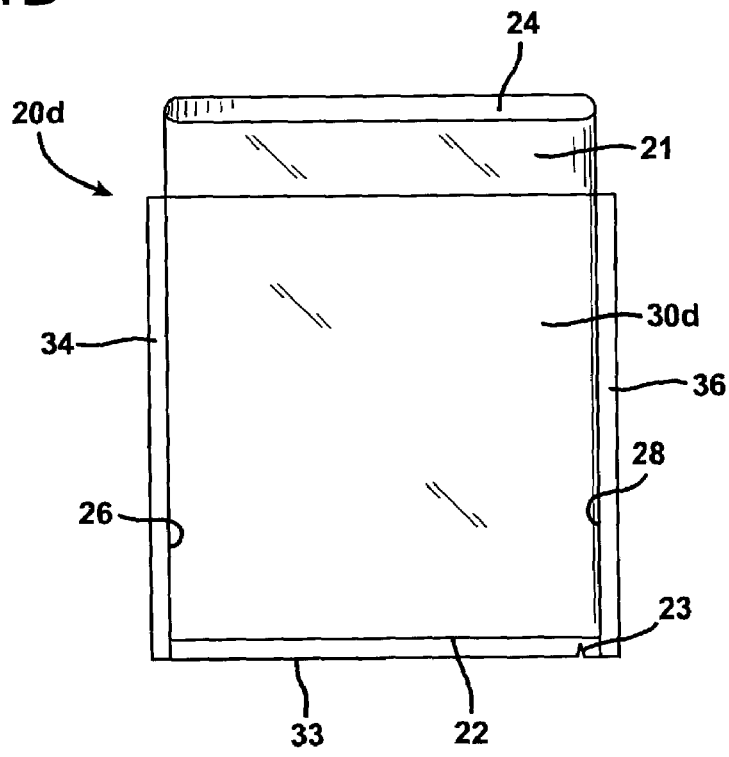
FIG. 1D illustrates a lay-flat view of a third end-seal patch bag in accordance with the present invention.

FIG. 1D illustrates patch bag 20D, which is yet another preferred end-seal patch bag in accordance with the present invention. Patch bag 20D is similar to patch bag 20B of FIG. 1B, but differs in that it has first patch 30D (see FIG. 1D) on its first lay flat side, and corresponding second patch 32D (not illustrated) adhered to its second lay flat side. As with the patch bag of FIG. 1B, patch bag 20D has patches 30D and 32D overhanging first and second side edges 26 and 28 of bag 21. However, rather than stopping short of bottom edge 33, each of patches 30D and 32D extends all the way to bottom edge 33 of bag 21. A longitudinal cross-sectional view of the seal region of patch bag 20D appears generally as illustrated in FIG. 3, except that patches 30D and 32D extend all the way to bottom edge 33. Notably, as in FIG. 3, the patches 30D and 32D are smooth over the seal, i.e., free of seal impression from seal 22. Tear notch 23 on bottom edge 33 provides a means for easy-opening of the package after a product is placed inside, and sealed within, patch bag 20C. Because patches 30D and 32D extend to bottom edge 33, tear notch 23 is through both lay-flat sides of the bag as well as through patch 30D and patch 32D. This assists in initiating a longitudinal tear through both patches and both lay-flat sides of the bag, to facilitate easy opening. More particularly, tear notch 23 assists in forming a tear upward, through seal 22 and along the length of both bag 21, as well as through patches 30D and 32D.

Figure 1E:
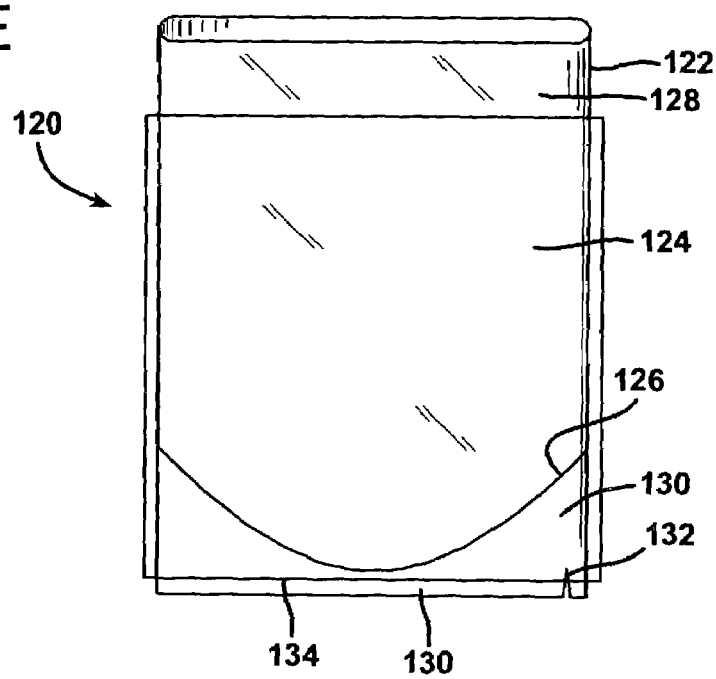
FIG. 1E illustrates a lay-flat view of an alternative end-seal patch bag in accordance with the present invention.

FIG. 1E illustrates an alternative end-seal patch bag 120 in accordance with the present invention. Patch bag 120 has bag 122 to which patch 124 is adhered, with bag 122 having convex end seal 126. Patch 124 does not cover upper region 128 of bag 122, so that a packer can easily seal the bag closed after placing a product in the patch bag. Below convex end seal 126 is bag skirt area 130, which has easy-open tear notch 132 therein, with the tear notch extending far enough inward from bottom edge 134 of bag 122 to provide a tear notch through the film from which patch 124 is made. In this manner, the patch bag can be easily opened by tearing across both the bag film and the patch film. Convex end seal 126 leaves more space for easy-open tear notch 132, especially near the bottom corner of bag 122. Preferably, the bag has a patch adhered to each lay-flat side, with the patches being of the same size and in the same position relative to the open top edge of the bag, end seal 126, bottom edge 134, and the side edges. As illustrated in FIG. 1E, portions of patch 124 overhang each of the side edges of bag 122. A corresponding patch (not illustrated) adhered to the other lay-flat side of bag 122 has corresponding overhanging areas which are adhered to the overhanging areas of patch 124. Of course, tear notch 132 preferably also extends through this second patch, to ensure easy opening of patch bag 120.

Figure 4A:
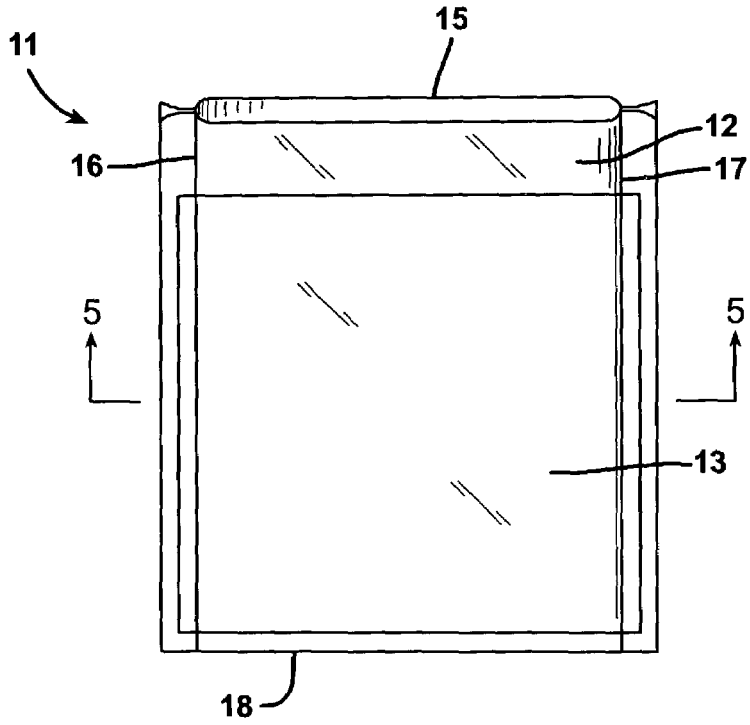
FIG. 4A illustrates a lay-flat view of a side-seal patch bag in accordance with the present invention.
Figure 5:
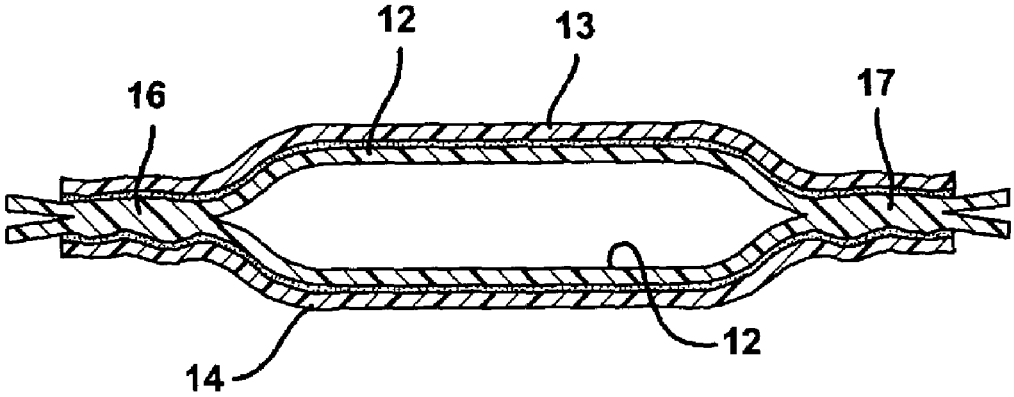
FIG. 5 illustrates a transverse cross-sectional view of the patch bag of FIG. 4A, taken through section 5—5 thereof.
Figure 6:
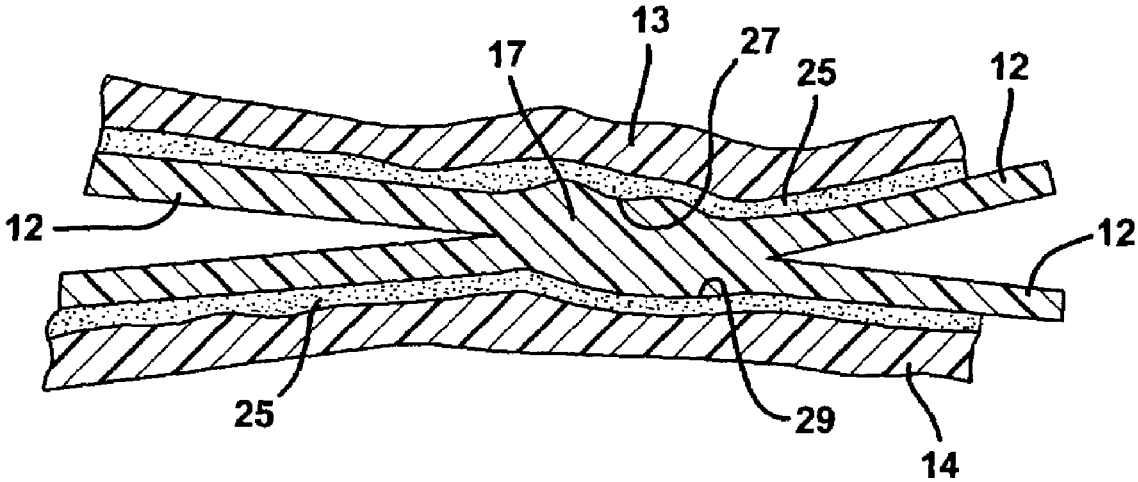
FIG. 6 illustrates a greatly enlarged view of a portion FIG. 5 which includes the seal.

FIG. 4A illustrates a preferred lay-flat side-seal patch bag 11, in a lay-flat position, this patch bag also being in accordance with the present invention. FIG. 5 is a transverse cross-sectional view of patch bag 11, taken through section 5—5 of FIG. 4A. FIG. 6 is an enlarged view of second side seal 17 illustrated in FIG. 5. Viewing FIGS. 4A, 5, and 6 together, patch bag 11 comprises side-seal bag 12 having first patch 13 adhered to a first lay-flat side of bag 12, and second patch 14 (see FIG. 5) adhered to second lay-flat side of bag 12. Bag 12 is formed from a seamless tubing which has been slit lengthwise along one edge, or from a folded flat film, and has an open top established by top edge 15, first and second side seals 16 and 17, and folded bottom edge 18 forming the bottom of the bag. First patch 13 and second patch 14 are each adhered to bag 12 with an adhesive, and as illustrated in FIG. 4A, both first patch 13 and second patch 14 cover a portion, but not the entire length, of side seals 16 and 17, respectively. First patch 13 and second patch 14 have a width less than the lay-flat width of bag 12, and do not extend to either top edge 15 or folded bottom edge 18. FIG. 6 is analogous to FIG. 3, in that it illustrates side seal 16 in which seal impressions 27 and 29 are formed on the film from which bag 12 is made, with patches 13 and 14 being adhered over seal 16 but being free of seal impressions 27 and 29. Of course, an enlarged view of second side seal 17 would correspond with the enlarged view of FIG. 6. Preferably, bag 12 is made from a heat-shrinkable film, with the bag film being held under tension during heat sealing, as disclosed in detail below.

Figure 4B:
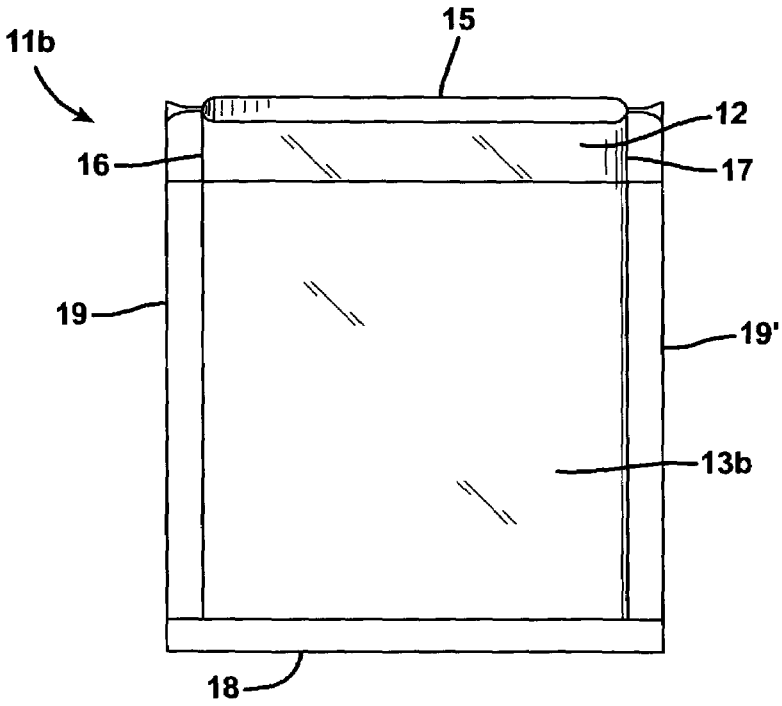
FIG. 4B illustrates a lay-flat view of an alternative side-seal patch bag.

FIG. 4B illustrates patch bag 1B, which is another preferred side-seal patch bag in accordance with the present invention. Patch bag 11B is similar to patch bag 11 of FIG. 4A, but differs in that it has patch 13B (see FIG. 4B) on a first lay-flat side of bag 12, and corresponding second patch 14B (not illustrated) adhered to second lay-flat side (not illustrated) of bag 12. Each of patches 13B and 14B extend all the way to the bag side edges 19 and 19. Otherwise, patch bag 11B corresponds with patch bag 11 of FIG. 4A.

Figure 7:
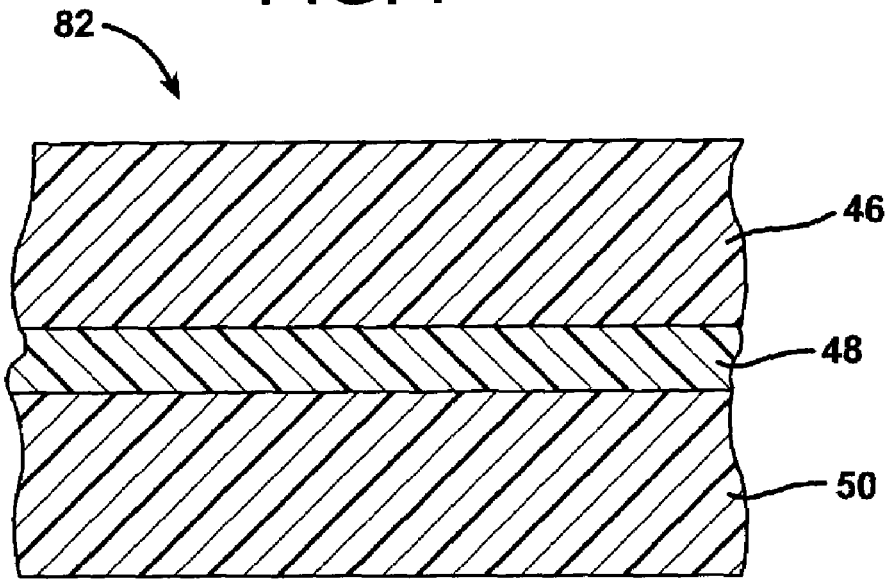
FIG. 7 illustrates a cross-sectional view of a preferred patch film for use in a patch bag in accordance with the present invention.

FIG. 7 illustrates a cross-sectional view of a preferred heat-shrinkable multilayer film 82 for use as the patch film in, for example, the patch bags illustrated in FIGS. 1A, 1B, 1C, 1D, 4A, and 4B. Preferred multilayer film 82 has a physical structure, in terms of number of layers, layer thickness, layer arrangement and orientation, and layer chemical composition, as set forth in Table I, below. In Table I, the resins used are as set forth in Table IA.

TABLE I

| Layer Designation | Layer Function | Layer Chemical Identity | Layer Thickness (mils) |
|---|---|---|---|
| 46 | Abuse and puncture resistant layer | 75% VLDPE #1<br>20.5% LLDPE #1<br>4.5% additive package #1 | 1.91 |
| 48 | Self weld layer | 100% EVA #1 | 0.34 |
| 50 | Abuse and puncture-resistant layer | 75% VLDPE #1<br>20.5% LLDPE #1<br>4.5% additive package #1 | 1.91 |

TABLE 1A

| Resin Code | Commercial Name | Melt Index | Density (gm/cm$^3$) | Comonomer Type/ Comonomer Content | Manufacturer |
|---|---|---|---|---|---|
| VLDPE #1 | ATTANE ® 4203 very low density polyethylene | 0.8 | 0.905 | 11.5%/$C_8$ | Dow |
| LLDPE #1 | SCLAIR ® 11C1 linear low density polyethylene | 0.8 | 0.918 | — | Nova Chemicals |
| EVA #1 | ESCORENE ® LD761.36 ethylene/vinyl acetate copolymer | 5.7 | 0.950 | Vinyl acetate/ 28% | Exxon Chemical Company |
| Additive Package #1 | L-710-AB (antiblock & UV fluorescence additive) | 4.5 | 0.945 | N/A | Bayshore Industrial, Inc. |

The patch film had a total thickness of 5.4 mils and exhibited a total free shrink at 185° F. of 55 percent. It had a peak load impact strength of 530 Newtons, an indexed peak load impact strength of 98 Newtons/mil, and an energy to break of 1.74 Joules/mil. An alternative heat-shrinkable patch film is a monolayer film containing single site catalyzed ethylene/alpha-olefin copolymer.

Figure 8:
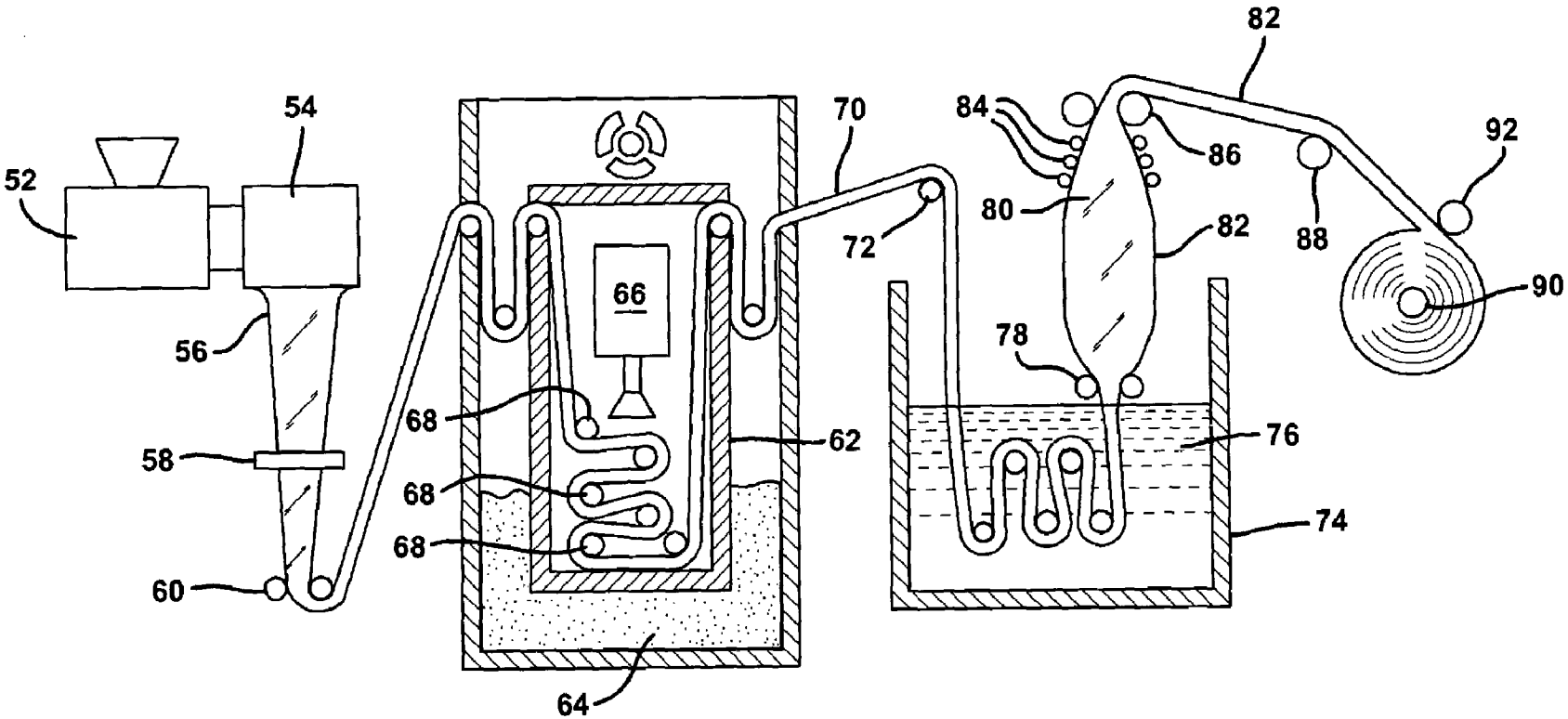
FIG. 8 illustrates a schematic view of a preferred process for making the multilayer film of FIG. 7.

FIG. 8 illustrates a schematic of a preferred process for producing the multilayer film for use in the patch in the patch bag of the present invention, e.g. the patch film illustrated in FIG. 7, described above. In the process illustrated in FIG. 8, solid polymer beads (not illustrated) are fed to a plurality of extruders 52 (for simplicity, only one extruder is illustrated). Inside extruders 52, the polymer beads are forwarded, melted, and degassed, following which the resulting bubble-free melt is forwarded into die head 54, and extruded through annular die, resulting in tubing 56 which is 5–40 mils thick, more preferably 20–30 mils thick, still more preferably, about 25 mils thick.

After cooling or quenching by water spray from cooling ring 58, tubing 56 is collapsed by pinch rolls 60, and is thereafter fed through irradiation vault 62 surrounded by shielding 64, where tubing 56 is irradiated with high energy electrons (i.e., ionizing radiation) from iron core transformer accelerator 66. Tubing 56 is guided through irradiation vault 62 on rolls 68. Preferably, tubing 56 is irradiated to a level of 10 megarads ("MR").

After irradiation, irradiated tubing 70 is directed over guide roll 72, after which irradiated tubing 70 passes into hot water bath tank 74 containing hot water 76. The now collapsed irradiated tubing 70 is submersed in the hot water for a retention time of at least about 5 seconds, i.e., for a time period in order to bring the film up to the desired temperature, following which supplemental heating means (not illustrated) including a plurality of steam rolls around which irradiated tubing 70 is partially wound, and optional hot air blowers, elevate the temperature of irradiated tubing 70 to a desired orientation temperature of from about 240° F.–250° F. A preferred means for heating irradiated tubing 70 is with an infrared oven (not illustrated), by exposure to infrared radiation for about 3 seconds, to bring the tubing up to about 240–250° F. Thereafter, irradiated film 70 is directed through nip rolls 78, and bubble 80 is blown, thereby transversely stretching irradiated tubing 70. Furthermore, while being blown, i.e., transversely stretched, irradiated film 70 is drawn (i.e., in the longitudinal direction) between nip rolls 78 and nip rolls 86, as nip rolls 86 have a higher surface speed than the surface speed of nip rolls 78. As a result of the transverse stretching and longitudinal drawing, irradiated, biaxially-oriented, blown tubing film 82 is produced, this blown tubing preferably having been both stretched at a ratio of from about 1:1.5–1:6, and drawn at a ratio of from about 1:1.5–1:6. More preferably, the stretching and drawing are each performed at a ratio of from about 1:2–1:4. The result is a biaxial orientation of from about 1:2.25–1:36, more preferably, 1:4–1:16. While bubble 80 is maintained between pinch rolls 78 and 86, blown tubing 82 is collapsed by rolls 84, and thereafter conveyed through nip rolls 86 and across guide roll 88, and then rolled onto wind-up roller 90. Idler roll 92 assures a good wind-up.

Figure 9:
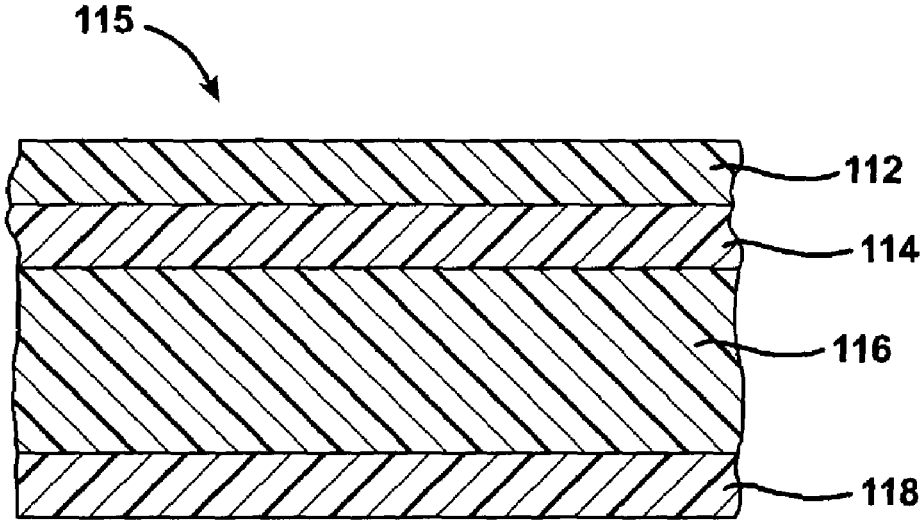
FIG. 9 illustrates a cross-sectional view of a preferred bag film for use in accordance with the present invention.

Preferably, the stock film from which the bag is formed has a total thickness of from about 1.5 to 5 mils; more preferably, about 2.5 mils. Preferably the stock film from which the bag is formed is a multilayer film having from 3 to 7 layers; more preferably, 4 layers. FIG. 9 illustrates a cross-sectional view of a preferred multilayer film 115 for use as the tubing film stock from which bag 21 (i.e., the bag illustrated in FIGS. 1A, 1B, 1C) or 12 (i.e., the bag of FIGS. 4A, 4B, 5, and 6) is formed. Multilayer film 115 has a physical structure, in terms of number of layers, layer thickness, and layer arrangement and orientation in the patch bag, and a chemical composition in terms of the various polymers, etc. present in each of the layers, as set forth in Table II, below.

TABLE II

| Layer Designation | Layer Function | Layer Chemical Identity | Layer Thickness (mils) |
|---|---|---|---|
| 112 | Outside and abuse layer | 90% EVA #2<br>10% HDPE #1 | 0.58 |
| 114 | $O_2$-Barrier layer | 96% VDC/MA #1;<br>2% epoxidized soybean oil; and<br>2% bu-A/MA/bu-MA terpolymer | 0.19 |
| 116 | Puncture-resistant | 85% LLDPE #2<br>15% EBA #1 | 1.15 |
| 118 | Sealant and inside layer | 80% SSPE#1<br>20% LLDPE #3 | 0.48 |

TABLE IIB

| Resin Code | Commercial Name | Melt Index | Density (gm/cm$^3$) | Comonomer Type/ Comonomer Content | Manufacturer |
|---|---|---|---|---|---|
| LLDPE #2 | DOWLEX ® 2045.03 linear low density polyethylene | 1.1 | 0.920 | Octene/6.5% | The Dow Chemical Company (Midland, Michigan) |
| LLDPE #3 | ESCORENE ® LL3003.32 linear low density polyethylene | — | — | — | Exxon Chemical Company (Baytown, Texas) |
| EVA #2 | ESCORENE ® LD318.92 Ethylene/vinyl acetate copolymer | 2.0 | 0.930 | Vinyl acetate/ 9% | Exxon Chemical Company |
| EBA #1 | SP1802 Ethylene/butyl acrylate copolymer | — | — | butyl acrylate/ 18% | Chevron Chemical Company (Houston, Texas) |
| HDPE #1 | Fortiflex 60-500-119 high density polyethylene | — | — | — | Solvay Polymers (Deer Park, Texas) |
| VDC/MA #1 | SARAN ® MA-134 Vinylidene chloride copolymer | — | — | Methyl acrylate | The Dow Chemical Company |
| SSPE #1 | AFFINITY ® single site catalyzed polyethylene | — | — | Octene | The Dow Chemical Company |
| Epoxidized soybean oil | PLAS-CHEK ® 775 | — | — | — | Bedford Chemical Division of Ferro Corporation, (Walton Hills, Ohio) |
| Bu-A/MA/bu-MA terpolymer | METABLEN ® L-1000 | — | — | — | Elf Atochem North America, Inc., (Philadelphia, Pennsylvania) |

Figure 10:
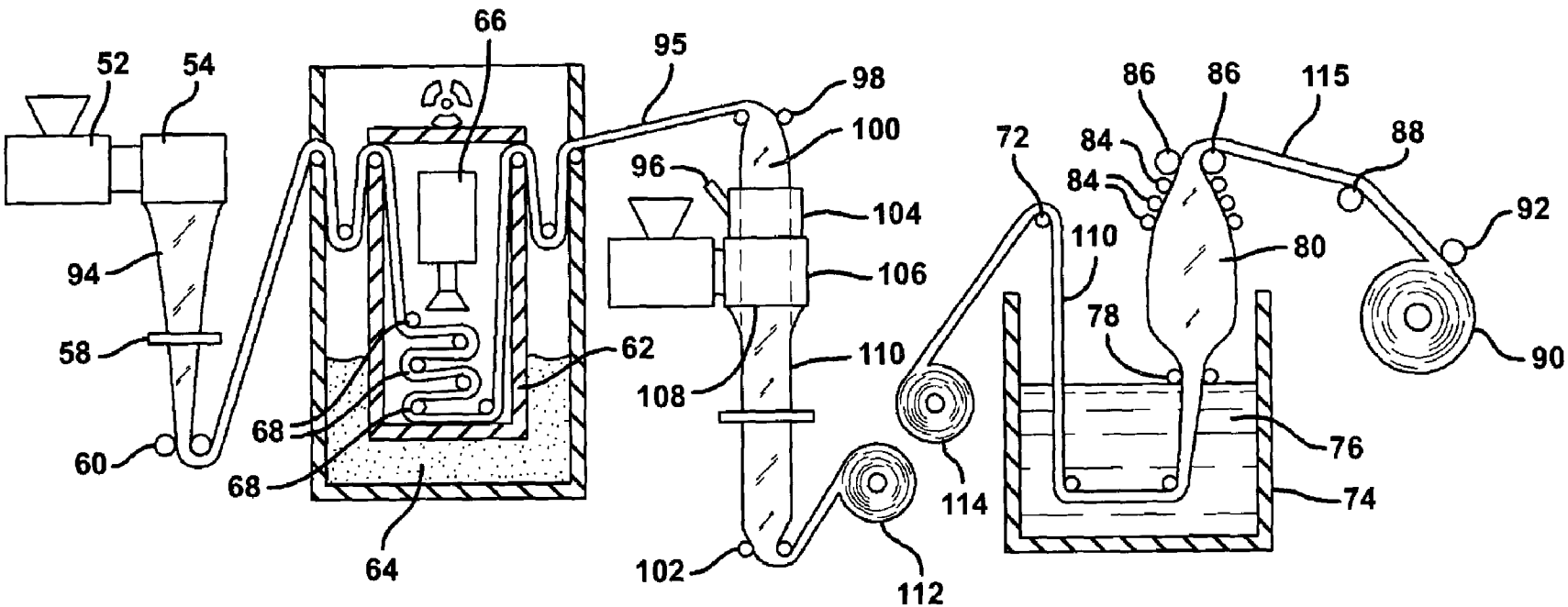
FIG. 10 illustrates a schematic view of a preferred process for making the multilayer film of FIG. 9.

FIG. 10 illustrates a schematic of a preferred process for producing the multilayer film of FIG. 9. In the process illustrated in FIG. 10, solid polymer beads (not illustrated) are fed to a plurality of extruders 52 (for simplicity, only one extruder is illustrated). Inside extruders 52, the polymer beads are forwarded, melted, and degassed, following which the resulting bubble-free melt is forwarded into die head 54, and extruded through an annular die, resulting in tubing 94 which is 10 to 30 mils thick, more preferably 15 to 25 mils thick.

After cooling or quenching by water spray from cooling ring 58, tubing 94 is collapsed by pinch rolls 60, and is thereafter fed through irradiation vault 62 surrounded by shielding 64, where tubing 94 is irradiated with high energy electrons (i.e., ionizing radiation) from iron core transformer accelerator 66. Tubing 94 is guided through irradiation vault 62 on rolls 68. Preferably, tubing 94 is irradiated to a level of about 4.5 MR.

After irradiation, irradiated tubing 95 is directed through nip rolls 98, following which tubing 95 is slightly inflated, resulting in trapped bubble 100. However, at trapped bubble 100, the tubing is not significantly drawn longitudinally, as the surface speed of nip rolls 102 are about the same speed as nip rolls 98. Furthermore, irradiated tubing 95 is inflated only enough to provide a substantially circular tubing without significant transverse orientation, i.e., without stretching.

Inflated, irradiated tubing 95 is passed through vacuum chamber 104, and thereafter forwarded through coating die 106. Second tubular film 108 is melt extruded from coating die 106 and coated onto slightly inflated, irradiated tube 95, to form extrusion-coated tubular film 110. Second tubular film 108 preferably comprises an $O_2$-barrier layer, which does not pass through the ionizing radiation. Further details of the above-described coating step are generally as set forth in U.S. Pat. No. 4,278,738, to BRAX et. al., which is hereby incorporated by reference thereto, in its entirety.

After irradiation and coating, two-ply tubing film 152 is wound up onto windup roll 112. Thereafter, windup roll 112 is removed and installed as unwind roll 114, on a second stage in the process of making the tubing film as ultimately desired. Two-ply tubular film 110, from unwind roll 114, is unwound and passed over guide roll 72, after which two-ply tubular film 110 passes into hot water bath tank 74 containing hot water 76. The now collapsed, irradiated, coated tubular film 110 is submersed in hot water 76 (having a temperature of about 210° F.) for a retention time of at least about 5 seconds, i.e., for a time period in order to bring the film up to the desired temperature for biaxial orientation. Thereafter, irradiated tubular film 110 is directed through nip rolls 78, and bubble 80 is blown, thereby transversely stretching tubular film 110. Furthermore, while being blown, i.e., transversely stretched, nip rolls 86 draw tubular film 110 in the longitudinal direction, as nip rolls 86 have a surface speed higher than the surface speed of nip rolls 78. As a result of the transverse stretching and longitudinal drawing, irradiated, coated biaxially-oriented blown tubing film 115 is produced, this blown tubing preferably having been both stretched in a ratio of from about 1:1.5–1:6, and drawn in a ratio of from about 1:1.5–1:6. More preferably, the stretching and drawing are each performed a ratio of from about 1:2–1:4. The result is a biaxial orientation of from about 1:2.25–1:36, more preferably, 1:4–1:16. While bubble 80 is maintained between pinch rolls 78 and 86, blown tubing film 115 is collapsed by rolls 84, and thereafter conveyed through nip rolls 86 and across guide roll 88, and then rolled onto wind-up roll 90. Idler roll 92 assures a good wind-up.

The polymer components used to fabricate multilayer films according to the present invention may also contain appropriate amounts of other additives normally included in such compositions. These include antiblocking agents (such as talc), slip agents (such as fatty acid amides), fillers, pigments and dyes, radiation stabilizers (including antioxidants), fluorescence additives (including a material which fluoresces under ultraviolet radiation), antistatic agents, elastomers, viscosity-modifying substances (such as fluoropolymer processing aids) and the like additives known to those of skill in the art of packaging films.

The multilayer films used to make the patch bag of the present invention are preferably irradiated to induce crosslinking, as well as corona treated to roughen the surface of the films which are to be adhered to one another, especially if the patch is adhered to the bag with corona treatment. In the irradiation process, the film is subjected to an energetic radiation treatment, such as corona discharge, plasma, flame, ultraviolet, X-ray, gamma ray, beta ray, and high energy electron treatment, which induce cross-linking between molecules of the irradiated material. The irradiation of polymeric films is disclosed in U.S. Pat. No. 4,064,296, to BORNSTEIN, et. al., which is hereby incorporated in its entirety, by reference thereto. BORNSTEIN, et. Al. Discloses the use of ionizing radiation for crosslinking the polymer present in the film.

Radiation dosages are referred to herein in terms of the radiation unit "RAD", with one million RADS, also known as a megarad, being designated as "MR", or, in terms of the radiation unit kiloGray (kGy), with 10 kiloGray representing 1 MR, as is known to those of skill in the art. A suitable radiation dosage of high energy electrons is in the range of up to about 16 to 166 kGy, more preferably about 40 to 90 kGy, and still more preferably, 55 to 75 kGy. Preferably, irradiation is carried out by an electron accelerator and the dosage level is determined by standard dosimetry processes. Other accelerators such as a van der Graaf or resonating transformer may be used. The radiation is not limited to electrons from an accelerator since any ionizing radiation may be used.

As used herein, the phrases "corona treatment" and "corona discharge treatment" refer to subjecting the surfaces of thermoplastic materials, such as polyolefins, to corona discharge, i.e., the ionization of a gas such as air in close proximity to a film surface, the ionization initiated by a high voltage passed through a nearby electrode, and causing oxidation and other changes to the film surface, such as surface roughness.

Corona treatment of polymeric materials is disclosed in U.S. Pat. No. 4,120,716, to BONET, issued Oct. 17, 1978, herein incorporated in its entirety by reference thereto, discloses improved adherence characteristics of the surface of polyethylene by corona treatment, to oxidize the polyethylene surface. U.S. Pat. No. 4,879,430, to HOFFMAN, also hereby incorporated in its entirety by reference thereto, discloses the use of corona discharge for the treatment of plastic webs for use in meat cook-in packaging, with the corona treatment of the inside surface of the web to increase the adhesion of the meat to the proteinaceous material. Although corona treatment is a preferred treatment of the multilayer films used to make the patch bag of the present invention, plasma treatment of the film may also be used.

One preferred process for making the patch bag of the present invention is carried out by making the heat-shrinkable bag, film in accordance with the process of FIG. 10, described above, resulting in a continuous, seamless, heat-shrinkable barrier film tubing. This heat-shrinkable film tubing is then transversely heat sealed at one or more desired intervals, using an impulse type means for heat sealing, as known to those skilled in- the art. During sealing, the heat-shrinkable film tubing is held under longitudinal tension. The tension can be maintained by passing-the tubing between a pair of infeed nip rollers upstream of the sealing apparatus, with tension being generated and maintained by a winder downstream of the sealing apparatus. Alternatively, a second set of nip rollers can be substituted for the winder. Because the heat-shrinkable film tubing would tend to shrink when heated during the sealing process, it has been found that adequate longitudinal tension (i.e., to prevent transverse film puckering) is maintained even if the winder rotates at a speed which is from 1 percent to 6 faster slower than the speed of the infeed nip rollers, in order to slightly stretch the film to maintain the desired tension during sealing. For example, when sealing across tubing having a lay-flat width of 13 inches, the tubing was held under 40 pounds of tension during transverse sealing (using an impulse sealing apparatus with 5 amps on the seal bar). Tension was maintained throughout the scaling process (including during subsequent cooling of the seal to ambient temperature), as well as during wind up of the sealed tubing. The winder speed was set at a rate to ensure that 40 pounds of tension was maintained on the film tubing which was being sealed. Preferably, the tension in pounds is from 1 to 5 times the lay-flat width of the bag film in inches, more preferably 2 to 4 times, more preferably 3 times.

Maintaining tension on the heat-shrinkable film during heat sealing has been found to both prevent the film from "puckering" as generally occurs in conversion of heat-shrinkable seamless tubing to end-seal bags. In conventional bag conversion, the impulse heat sealing and cutting operation are carried out simultaneously, leaving the hot seal area free to contract transversely (and longitudinally) because the tubing is cut transversely, with the transverse shrinkage resulting in bag "puckering" due to the fact that the heat from the sealing operation causes shrinkage to be confined to a relatively short area along either side of the seal. Puckering is an impediment to the subsequent adhesion of the patch film over the seal area of the bag, as puckering makes it more difficult to produce a continuous lamination of the patch film to the bag film in the area of the puckering.

Moreover, maintaining tension on the tubing during heat sealing not only prevents or reduces puckering, but also reduces the thickness of the seal impression, resulting in a noticeably smoother seal impression on the bag. In conventional conversion of seamless tubing to bags, the lengthwise contraction of the unrestrained bag film results in a thickening of the bag film in the seal area and in regions adjacent the seal area. However, by maintaining tension during impulse heat sealing, the bag film undergoes little or no lengthwise contraction, thereby keeping the bag film from thickening in the region at and immediately adjacent to the heat seal.

Although the preferred 13 inch (lay-flat width) bag film tubing described above (see Table II and associated description thereof) was transversely sealed approximately every 23 inches, and was held at a tension of 40 pounds during sealing, preferably a narrower tubing of the same film would be sealed under less tension, while a wider tubing of the same film would be sealed under more tension. The amount of tension to be used during sealing is enough to prevent contraction of the heat-shrinkable film from the heat imparted by the sealing means, but low enough not to pull the film apart due to temporary weakening of the film at the location of the seal. For most heat-shrinkable bags used for the packaging of meat products, the tension would be in the range of 5–200 pounds, more preferably 5–100 pounds, more preferably 10–80 pounds, more preferably 15–70 pounds, more preferably 20–65 pounds, more preferably 25–60 pounds, more preferably, 30–50 pounds. Of course, higher tension is required for film exhibiting greater shrink force, while lower tension would be adequate for film exhibiting lesser shrink force. In addition, the film tubing should be kept spread transversely by being in contact with various processing rollers, including both single freewheeling rollers as well as nip rollers.

The longitudinal shrink tension of the film, activated by the heat sealing process, assists in maintaining tension on the film tubing at a level adequate to prevent the transverse puckering which would result if no lengthwise tension is maintained on the film tubing. Each heat seal is allowed to cool while the film tubing remains under tension. After the seal is made and cooled, a plurality of heat-shrinkable patches are adhered to a first lay-flat side of the tubing. Each patch is positioned on the tubing so that it covers at least one transverse heat seal. In order to ultimately produce an end-seal patch bag, variations on:

(a) the length and width of the patch relative to the tubing,
(b) the positioning of the patch relative to the transverse seal, and
(c) the spacing of the patches from one another to result in the desired uncovered area of the bag above the seal (i.e., leaving an uncovered area through which the packer can efficiently make a heat seal after an article has been placed into the bag, without having to seal through the patch)

are apparent from considering the end-seal patch bags of FIGS. 1A, 1B, 1C, and 1D. However, in each case the patch is sized and positioned to cover at least a portion of the seal.

The process of producing end-seal patch bags in accordance with the present invention can (optionally) include adhering patches to the second lay-flat side of the tubing. Preferably, the patches adhered to the second lay-flat side of the seamless tubing are of the same size as the patches adhered to the first lay-flat side of the tubing. Moreover, the patches adhered to the second lay-flat side of the tubing are preferably adhered in the same location as the patches on the first lay-flat side, i.e., relative to the transverse seals across the tubing. After the patches have been adhered to the tubing, the resulting tubing/patch laminate is converted into a plurality of end-seal patch bags by being transversely cut at locations a short distance downstream from each transverse seal. Each transverse cut forms the bottom edge of the patch bag immediately upstream of the cut, as well as the top edge of the patch bag immediately downstream of the cut.

In a preferred process for making side-seal patch bags in accordance with the present invention, a heat-shrinkable bag film tubing is extruded in accordance with the process of FIG. 10, described above, and thereafter irradiated, extrusion coated, and oriented, resulting in a continuous, seamless, heat-shrinkable barrier film tubing. This film tubing is then transversely heat sealed at desired intervals, using an impulse type means for heat sealing. The film tubing is held under tension during sealing, as described above, with the heat seals being allowed to cool while the sealed tubing remains under longitudinal tension. Patch film is then adhered to a first lay-flat side of the sealed tubing. The patch film is adhered to the sealed tubing so that a portion of the tubing along one side edge thereof is not covered by the patches. Upon slitting the tubing open at and along this uncovered side edge, and then making transverse cuts at appropriate locations and intervals, the uncovered region of the tubing becomes the upper end of the side seal bags, which the packer can readily seal through as described above with respect to end-seal bags.

In the production of the desired side-seal patch bag, variations on:

(a) the width of the patch(es) film relative to the width of the tubing, and
(b) the positioning of the patch(es) relative to the side edges of the tubing are apparent from considering the side-seal patch bags of FIGS. 4A and 4B. Unlike the making of end-seal patch bags, in the making of side-seal patch bags in accordance with the present invention, a "continuous patch" can be adhered along the length of the transversely sealed tubing to produce the tubing/patch laminate. While the patch film must still be positioned relative to the side edges of the sealed bag tubing, this process eliminates the need to register individual patches relative to the heat seals and relative to one another. This can significantly increase the efficiency of the process of making side-seal patch bags, and results in a patch bag in which the patch has a width identical to the width of the bag, i.e., as illustrated in FIG. 4B. Moreover, because the heat-shrinkable bag film tubing is first transversely sealed, with the patch film thereafter being adhered over the sealed tubing, both the sealing process and the patch film adhesion process can be carried out at relatively high speed. The sealing is relatively high speed because the seal need only be made through the bag film. The patch application is relatively high speed because there is no need to apply separate patches to the film, but rather a single, continuous patch film can be laminated over the full length of the sealed bag tubing.

Alternatively, discrete patches can be adhered to the bag film, with each patch covering at least a portion of at least one of the transverse heat seals across the tubing, resulting in a side-seal patch bag as illustrated in FIG. 4A. This process is more complex (and probably slower) than applying a continuous patch because the patch film must be cut into discrete patch-sized pieces, and must be registered on the sealed bag tubing so that it is positioned to cover a transverse seal. Moreover, if a second such patch is adhered to the opposite lay-flat side of the bag, the second patch is preferably registered so that it aligns with the first patch.

The final steps of making side seal patch bags in accordance with the invention are to (a) slit the tubing open by cutting along the uncovered side edge of the tubing, i.e., the side edge which is to form the open top of the bags, and (b) make a plurality of transverse cuts across the tubing/patch laminate, to form the bag side edges and separate each of the bags from one another.

Laminating the patch to the bag can be accomplished by a variety of methods, including the use of an adhesive, corona treatment, or even heat sealing. Adhesives are the preferred means for accomplishing the lamination. Examples of suitable types of adhesives include thermoplastic acrylic emulsions, solvent based adhesives and high solids adhesives, ultraviolet-cured adhesive, and electron-beam cured adhesive, as known to those of skill in the art. A preferred adhesive is a thermoplastic acrylic emulsion known as RHOPLEX® N619 thermoplastic acrylic emulsion, obtained from the Rohm & Haas Company, at Dominion Plaza Suite 545, 17304 Preston Rd., Dallas, Tex. 75252, Rohm & Haas having headquarters at 7th floor, Independence Mall West, Philadelphia, Pa. 19105. Another preferred adhesive is a urethane-based adhesive formulated by mixing 99 weight percent of a urethane resin sold by Ashland Specialty Chemical Company of Columbus, Ohio (a division of Ashland Inc.), under the trade name PURETHANE A-1078 CVAC resin with 1 weight percent of catalyst also sold by Ashland under the trade name C-CAT 104 catalyst.

Preferred patch films, bag films, processes for making patch bags, configurations of patches on bags, etc., are useful in whole or in part in conjunction with the patch bag and process of the present invention. More particularly, preferred patch bags and processes are disclosed in U.S. Pat. No. 4,755,403, to Ferguson, entitled "Protective Patch for Shrinkable Bag", U.S. Pat. No. 5,534,276, to Ennis, entitled "Bone-In Meat Containers", U.S. Pat. No. 6,383,537, to Brady et al, entitled "Patch Bag Having Overhanging Bonded Patches", U.S. Pat. No. 6,287,613, to Childress et al, entitled "Patch Bag Comprising Homogeneous Ethylene/Alpha-Olefin Copolymer", U.S. Ser. No. 09/426,827, to Mudar et al, filed 25 Oct. 1999, entitled "Patch Bag with Patch Containing High and Low Crystallinity Ethylene Copolymers" (European counterpart published as EP 1 095 874 A2), EP 0 913 338, to Mize et al, entitled "Patch Bag and Process of Making Same", AU 745,621B1, to Georgelos et al, entitled "Bag for Bone-In Meat Packaging", and AU 200227735, to Georgelos et al, entitled "Bag for Bone-In Meat Packaging", each of which is hereby incorporated, in its entirety, by reference thereto.

Although in general the bag according to the present invention can be used in the packaging of any product, the bag of the present invention is especially advantageous for the packaging of food products, especially fresh meat products comprising bone, especially cut bone ends present at or near the surface of the fresh meat product. Preferably, the meat product comprises at least one member selected from the group consisting of poultry, pork, beef, lamb, goat, horse, and fish. More preferably, the meat product comprises at least one member selected from the group consisting of ham, spareribs, picnic, back rib, short loin, short rib, whole turkey, and pork loin. Still more preferably, the meat product comprises bone-in ham, including both smoked and processed ham, fresh bone-in ham, turkey, chicken, and beef shank. Ribs are a particularly preferred cut for packaging in the patch bag of the present invention.

Although the present invention has been described in connection with the preferred embodiments, it is to be understood that modifications and variations may be utilized without departing from the principles and scope of the invention, as those skilled in the art will readily understand. Accordingly, such modifications may be practiced within the scope of the following claims.

What is claimed is:

1. A patch bag comprising:

(A) a lay-flat bag having an open top, a closed bottom, and first and second closed sides, the bag comprising a bag film, the bag including a heat seal of an inside surface of the bag film to itself, the bag having a heat seal impression on an outside surface thereof; and (B) a patch comprising a patch film, the patch film being adhered to the outside surface of the bag film and covering at least a portion of the heat seal impression on the outside surface of the bag film, the patch film having a smooth, unimpressed outer surface directly over the heat seal impression on the outside surface of the bag film.

2. The patch bag according to claim 1, wherein the bag film is heat shrinkable and exhibits a total free shrink of from 10 to 150 percent at 185° F., and the patch film is heat shrinkable and exhibits a total free shrink of from 10 to 150 percent at 185° F.

3. The patch bag according to claim 1, wherein the bag is an end seal bag, the bag film being in the form of a seamless tubing, the heat seal being a transverse end seal across the bag film.

4. The patch bag according to claim 3, wherein the patch is a first patch adhered to an outside surface of a first lay-flat side of the bag, the first patch having a first overhanging portion which overhangs a first side edge of the bag and a second overhanging portion which overhangs a second side edge of the bag, and a second patch adhered to an outside surface of a second lay-flat side of the bag, the second patch having a first overhanging portion which overhangs the first side edge of the bag and a second overhanging portion which overhangs the second side edge of the bag, with the first overhanging portion of the first patch and the first overhanging portion of the second patch being adhered to one another, and with the second overhanging portion of the first patch and the second overhanging portion of the second patch being adhered to one another, with both the first and second patches covering the transverse end seal.

5. The patch bag according to claim 3, wherein the bag has a skirt below the end seal, with the patch covering a portion of the skirt, with the bag film having a tear notch present in the skirt, the tear notch extending from a bottom edge of the patch bag to a position below the end seal.

6. The patch bag according to claim 5, wherein the end seal is convex with respect to a straight bottom edge of the bag.

7. The patch bag according to claim 6, wherein the patch is a first patch adhered to an outside surface of a first lay-flat side of the bag, the first patch having a first overhanging portion which overhangs a first side edge of the bag and a second overhanging portion which overhangs a second side edge of the bag, the patch bag further comprising a second patch adhered to an outside surface of a second lay-flat side of the bag, the second patch having a first overhanging portion which overhangs the first side edge of the bag and a second overhanging portion which overhangs the second side edge of the bag, with the first overhanging portion of the first patch and the first overhanging portion of the second patch being adhered to one another, and with the second overhanging portion of the first patch and the second overhanging portion of the second patch being adhered to one another, with both the first and second patches covering the end seal.

8. The patch bag according to claim 1, wherein the bag is a side-seal bag having a first side seal along a first side edge of the bag and a second side seal along a second side edge of the bag, with both the first and second side seals extending a full length of the bag, and with the patch covering at least a portion of the first side seal and at least a portion of the second side seal.

9. The side-seal patch bag according to claim 8, wherein the patch is a first patch adhered to an outside surface of a first lay-flat side of the bag, the first patch overhanging a bottom edge of the bag, the side-seal patch bag further comprising a second patch adhered to an outside surface of a second lay-flat side of the bag, the second patch also overhanging the bottom edge of the bag, with an overhanging portion of the first patch being adhered to an overhanging portion of the second patch.

10. The patch bag according to claim 8, wherein the bag has a skirt outward of the first side seal, the skirt extending from the first side seal to a first side edge, with the patch covering a portion of the skirt and a tear notch in the skirt, the tear notch being at least through the bag film, the tear notch extending from the first side edge of the bag towards the first side seal.

11. The patch bag according to claim 1, wherein the patch is adhered to the bag with an adhesive.

12. The patch bag according to claim 1, wherein the patch is adhered to the bag with corona treatment.

* * * * *